United States Patent [19]

Milberger et al.

[11] Patent Number: 4,919,460

[45] Date of Patent: Apr. 24, 1990

[54] WELLHEAD CASING HANGER SUPPORT MECHANISM

[75] Inventors: Lionel J. Milberger; Herman O. Henderson, Jr., both of Houston, Tex.

[73] Assignee: Vetco Gray Inc., Houston, Tex.

[21] Appl. No.: 307,412

[22] Filed: Feb. 6, 1989

[51] Int. Cl.[5] ..... E21B 33/04

[52] U.S. Cl. ..... 285/141; 205/143; 166/75.1; 166/208

[58] Field of Search ..... 166/382, 75.1, 85, 208; 285/140–143

[56] References Cited

U.S. PATENT DOCUMENTS

| | | | |
|---|---|---|---|
| 2,010,284 | 8/1935 | Wickersham | 285/141 |
| 2,178,549 | 11/1939 | Block . | |
| 3,284,111 | 11/1966 | Pinkard . | |
| 4,167,970 | 9/1979 | Cowan | 166/208 |
| 4,460,042 | 7/1984 | Galle, Jr. . | |
| 4,528,738 | 7/1985 | Galle, Jr. | 285/141 |
| 4,550,782 | 11/1985 | Lawson . | |
| 4,577,686 | 3/1986 | Milberger et al. | 166/208 |
| 4,595,053 | 6/1986 | Watkins et al. | 166/382 |
| 4,641,708 | 2/1987 | Wightman | 166/217 |
| 4,826,216 | 5/1989 | Hynes et al. | 166/208 |

FOREIGN PATENT DOCUMENTS 0261909 3/1988 European Pat. Off. .

*Primary Examiner*—Bruce M. Kisliuk

*Attorney, Agent, or Firm*—James E. Bradley

[57] ABSTRACT

A supporting mechanism for a casing hanger improves the load withstanding ability. The casing hanger is located in a wellhead housing. A recess is formed in the bore of the wellhead housing with an upward facing shoulder extending into the bore. An insert ring is stationarily and rigidly mounted in this recess. The insert ring has a load shoulder on its upper side. The load shoulder of the insert ring is considerably less in width than the recess shoulder. However, the insert ring has a greater hardness to increase the capacity of the insert ring. The casing hanger has an exterior load ring that lands on the insert ring. The load ring has threads which are cut to have clearances initially between the load flanks. A clearance also exists between the upper end of the load ring and a downward facing shoulder on the casing hanger. A protuberance on the upper end of the load ring maintains this upper clearance until the load flank clearances close up, then allows the upper clearance to close up to assure loading through the flanks.

5 Claims, 3 Drawing Sheets

Fig. 2
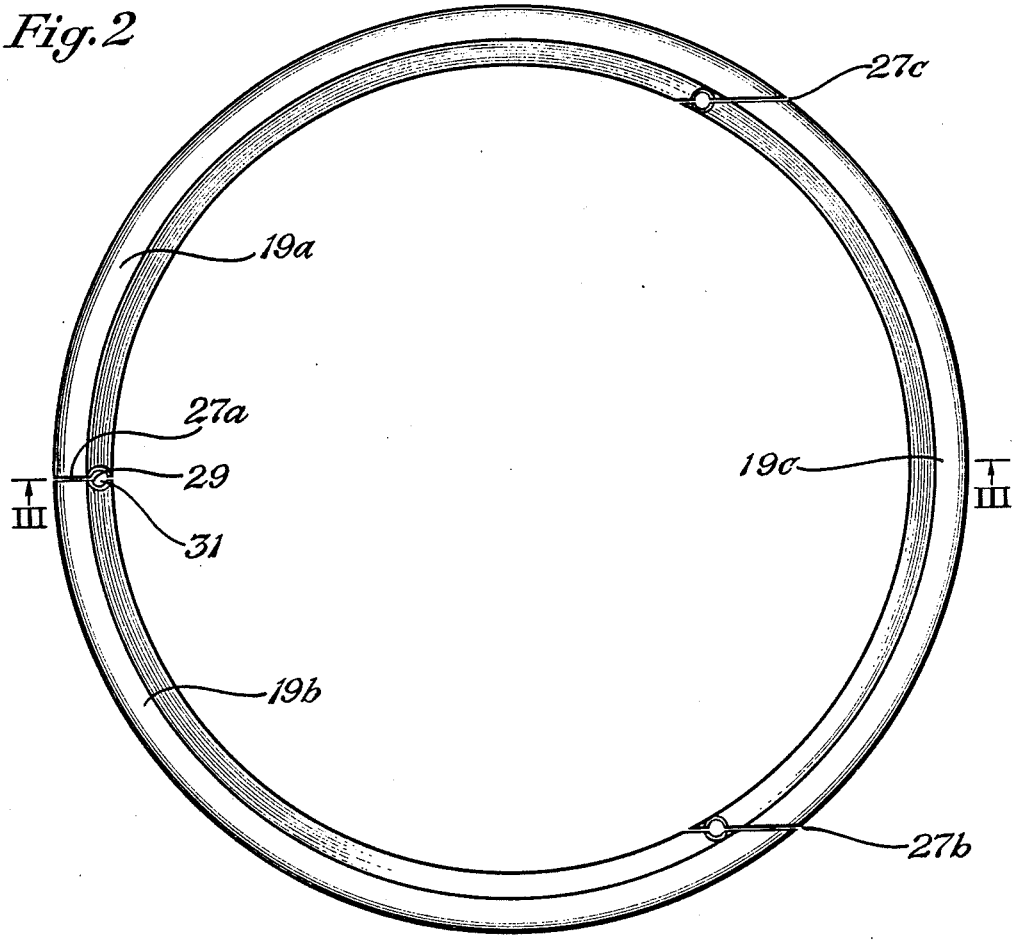
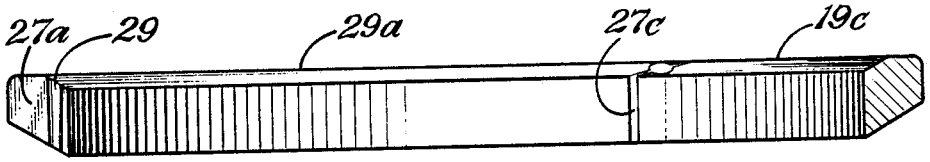
Fig. 3

WELLHEAD CASING HANGER SUPPORT MECHANISM

BACKGROUND OF THE INVENTION

1. Field of the Invention:

This invention relates in general to mechanisms for supporting a casing hanger in a wellhead and in particular to means for increasing the strength of the support.

2. Description of the Prior Art:

In subsea wells, a wellhead is located on the sea floor. A first string of casing will be lowered through the wellhead and supported on the wellhead by means of a casing hanger located at the top of the casing string. Additional smaller diameter strings of casing may be subsequently installed on the first casing hanger. Various mechanisms have been used in the past for supporting the casing hangers in the wellhead. These include single load shoulders, expanding latch mechanisms, and high friction devices.

The simplest and most economical method is to use a single load shoulder. The load shoulder is a conical shoulder located in the bore of the wellhead housing. The diameter of the bore will be smaller below the load shoulder than above. The casing hanger has a downward facing load shoulder which lands on the load shoulder in the bore.

A single load shoulder, however, has limited load capacity. The inner diameters of the wellhead housing bore both above and below the load shoulder have fixed requirements that limit the radial or transverse dimensions of the load shoulder. Also, the yield strength of the wellhead housing is typically only around 80,000 psi. This type of load shoulder is capable of withstanding the stresses imposed upon it due to loadings on the wellheads up to 10,000 psi working pressures. The problem is to have a shoulder capable of withstanding stresses imposed from working pressures up to 15,000 psi.

SUMMARY OF THE INVENTION

In this invention, an annular recess is formed in the bore of the single load shoulder. This recess extends outward, increasing the radial dimension of the load shoulder. An insert ring is stationarily and rigidly mounted in this recess. The insert ring has a lower surface that mates with the load shoulder. The insert ring has an upper shoulder surface which is contacted by the casing hanger. This upper shoulder surface is much smaller in radial extent than the recess within the shoulder. The upper shoulder extends radially no greater than the difference in diameter between the upper and lower portions of the bore of the wellhead housing above and below the recess shoulder.

The insert ring is made of a material that is considerably harder than the material of the wellhead housing. The load from the casing hanger is transmitted through the smaller insert shoulder to the larger recess shoulder. Because of the hardness of the material, the insert shoulder is able to withstand a much greater load. The recess shoulder is able to handle the greater load because of its greater radial extent extending into the recess.

BRIEF DESCRIPTION OF THE DRAWINGS

FIG. 2 is a top view of an insert ring shown removed from the wellhead housing.

FIG. 3 is a cross-sectional view of the insert ring of FIG. 2, taken along the line III—III.

DESCRIPTION OF THE PREFERRED EMBODIMENT

Figure 1:
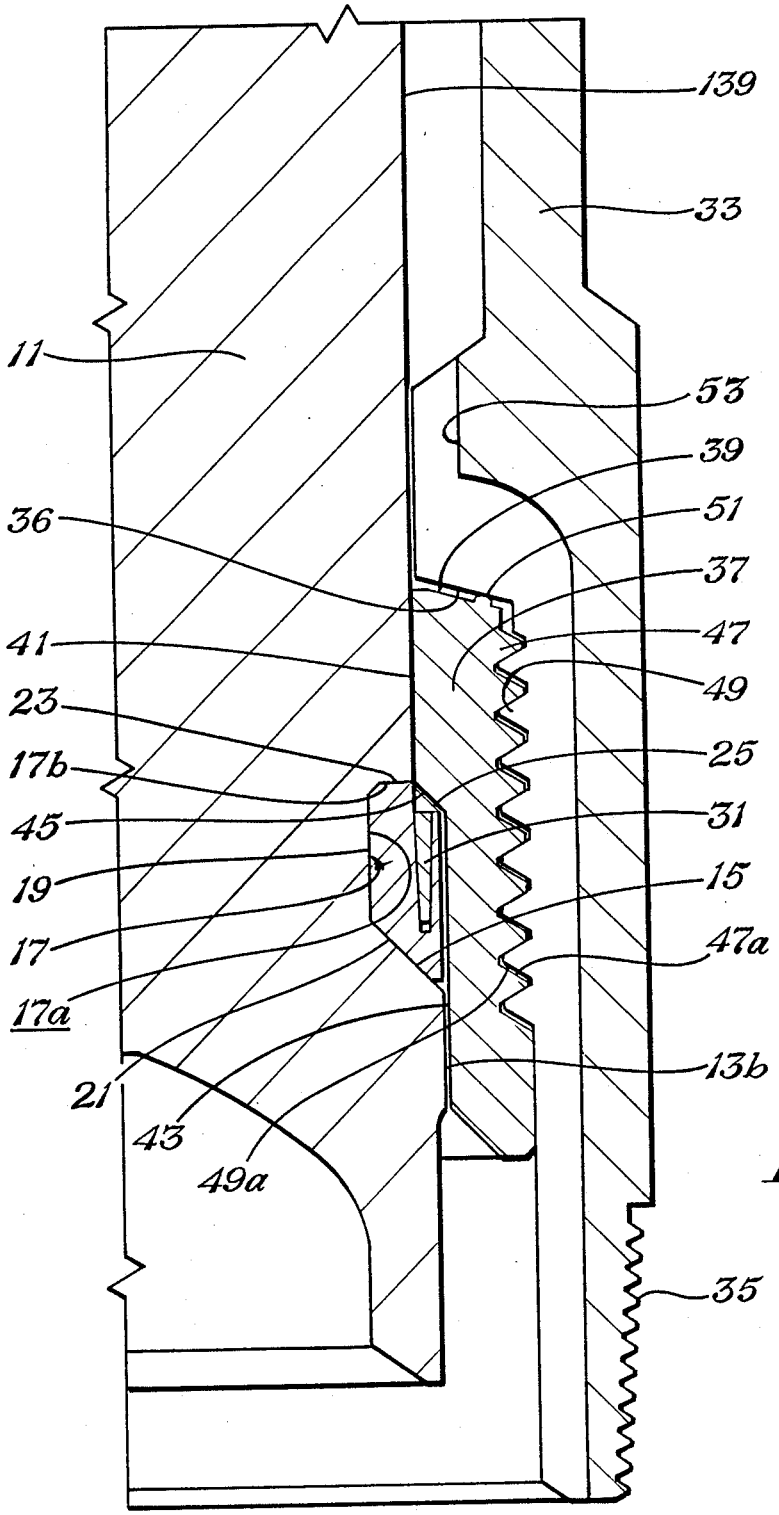
FIG. 1 shows a frontal sectional view of a load supporting mechanism for a casing hanger in a wellhead constructed in accordance with this invention.

Referring to FIG. 1, wellhead housing 11 is of a type that typically will be located on the subsea floor. It has a bore having an upper portion 13*a* and a lower portion 13*b*. The upper portion 13*a* is of larger inner diameter than the lower portion 13*b*. A shoulder 15 is located at the upper end of the bore lower portion 13*b*. Shoulder 15 is frusto-conical, facing upward and inward at an angle of about 30 degrees relative to horizontal.

A recess 17 is formed at the shoulder 15. The shoulder 15 forms the bottom of the recess 17. The recess 17 extends radially outward to a vertical wall 17*a*. The wall 17*a* has a diameter greater than the diameter of the bore upper portion 13*a*. Recess 17 has a downward facing upper shoulder or wall 17*b* that is perpendicular to the axis of the wellhead housing 11.

An insert ring 19 is rigidly and stationarily mounted inside the recess 17. The insert ring 19 has a lower side 21 that is a downward facing frusto-conical surface. The lower side 21 has the same dimensions as the recess shoulder 15 and mates with the recess shoulder 15. The insert ring 19 has an upper side 23 that is flat and perpendicular to the axis of the insert ring 19. The insert ring upper side 23 contacts the recess upper wall 17*b*. The insert ring 19 also has an outer diameter or wall that contacts the recess vertical wall 17*a*.

The insert ring 19 has an upper shoulder 25 that protrudes into the bore upper portion 13*a*. The upper shoulder 25 inclines at about a 30 degree angle relative to horizontal. Upper shoulder 25 is thus parallel to the shoulder 15.

The insert ring shoulder 25 has an inner diameter that is the same as the inner diameter of the bore lower portion 13*b*. The outer diameter of the insert ring shoulder 25 is the same diameter as the bore upper portion 13*a*. Consequently, the transverse dimension, measured from the inner to the outer side is much less than the transverse dimension of the recess shoulder 15, measured from the inner diameter to the vertical wall 17*a*. Preferably, the radial or transverse dimension of the insert ring shoulder 25 is one-half that of the recess shoulder 15.

The insert ring 19 is of a material that is considerably harder than the material of the wellhead housing 11. The insert ring 19 is preferably of a steel material having a yield strength of 120,000 psi, while the wellhead housing 11 is preferably of a steel material having a yield strength of 80,000 psi.

Referring to FIGS. 2 and 3, the insert ring 19 is cut into three separate segments 19*a*, 19*b* and 19*c*. The segments 19*a*, 19*b* and 19*c* are formed by making three machined cuts 27*a*, 27*b* and 27*c* after the insert ring 19 is formed. The cuts 27*a*, 27*b*, 27*c* are located about 120 degrees apart. One of the cuts 27*a* is preferably cut along a radial line of the axis of the insert ring 19. The other two cuts 27*b* and 27*c* are cut parallel to the cut 27*a*. Consequently, the cuts 27*b* and 27*c* will not be on a radial line. This enables the segments 19*a*, 19*b* and 19*c* to be inserted piece by piece into the recess 17 (FIG. 1)

without needing to flex any portions of the insert ring 19.

Before the cuts 27*a*, 27*b* and 27*c* are formed, a tapered hole 29 is drilled in the insert ring 19 in three places, 120 degrees apart. As shown in FIG. 1, the tapered hole 29 extends vertically downward from the shoulder 25. The tapered hole 29 does not extend all the way to the lower side 21. The cuts 27*a*, 27*b* and 27*c* are cut through these tapered holes 29. This results in a tapered groove on each end of each segment 19*a*, 19*b* and 19*c*. The tapered grooves mate with each other to define the tapered holes 29. A dowel pin 31 is inserted into the tapered holes 29 after the ring 19 is assembled in the recess 17. This locks the segments 19*a*, 19*b* and 19*c* together when in the recess 17.

A casing hanger 33 is lowered into the wellhead housing 11 after the insert ring 19 is positioned in the recess 17. The casing hanger 33 has threads 35 on its lower end which will be secured to the upper end of a string of casing (not shown). A downward facing shoulder 36 is located on the exterior of the casing hanger 33.

The casing hanger 33 also includes a load ring 37, which is mounted to its exterior below the shoulder 36. Load ring 37 has an upper rim 39 positioned to contact the shoulder 36. Load ring 37 has an upper exterior portion 41 that is slightly less than the diameter of the bore upper portion 13*a*. Load ring 37 has a lower exterior portion 43 that is slightly less than the diameter of the lower bore portion 13*b*. A downward facing load shoulder 45 is formed at the junction of the upper and lower portions 41, 43. The load shoulder 45 is frustoconical and has the same dimensions as the insert ring shoulder 25.

In the embodiment of FIG. 1, the load ring 37 is secured to the casing hanger 33 by means of coarse threads 47. The threads 47 are triangular in configuration, each having an upward facing load flank 47*a*. These threads 47 screw onto threads 49 formed on the exterior of the casing hanger 33. Each thread 49 has a downward facing load flank 49*a*. Vertical slots (not shown) extend through the threads 47 so as to allow the upper portion of the load ring 37 to expand outward when loaded. The threads 47, 49 are cut so that prior to loading, a clearance will exist between the load flanks 47*a*, 49*a*. This clearance is shown in FIG. 1.

A clearance also exists initially between the upper end 39 of the load ring 37 and the casing hanger shoulder 36. This clearance is greater than the clearance between the load flanks 47*a*, 49*a*. A protuberance 51 maintains this clearance until sufficient load is applied to close the clearances between the thread flanks 47*a* and 49*a*. This loads the threads 47,49. Then, further application of load will deform the protuberance 51 to close the clearance between the upper end 39 and the casing hanger shoulder 36. This assures that the threads 47, 49 will carry part of the load of the load ring 37, and not just the upper end 39.

A series of slots or channels 53 are cut along the exterior of the casing hanger 33. These slots 53 extend through the threads 49. This forms passages for the returns during cementing.

In operation, the insert ring 19 is inserted into the recess 17 before the wellhead housing 11 is lowered onto the sea floor and installed. This is handled by inserting first the segments 19*a*, 19*b* (FIG. 2), then the segment 19*c*. The parallel cuts 27*b* and 27*c* allow the insertion of the last segment 19*c* without having to flex any of the segments 19*a*, 19*b* or 19*c*. Then, dowel pins 31 are placed in the holes 29. The wellhead housing 11 is then lowered into place on the sea floor. Large diameter conductor pipe (not shown) will be attached to the lower end of the wellhead housing 11 and cemented into the well.

After the well is drilled deeper, a first string of casing is run. The casing hanger 33 will be secured to the upper end of the string of casing which is being lowered into the well. The casing hanger 33 will have the load ring 37 secured to it at the surface. When the casing hanger 33 moves down into the wellhead housing 11, the load ring 37 will contact the insert ring shoulder 25. The weight of the casing will be transmitted through the load ring 37 to the insert ring 19, and to the wellhead housing 11.

The protuberance 51 will begin to deform under the load. First, the clearances between the load flanks 47*a*, 49*a* will close up, these being smaller than the clearance between the upper end 39 of the load ring 37 and the casing hanger shoulder 36. When the clearances between the threads 47, 49 have closed, the deformation of protuberance 51 continues until the clearance between the upper end 39 and the shoulder 36 closes.

The insert shoulder 25 transmits all of the weight to the recess shoulder 15. The recess shoulder 15 has a radial dimension that is twice as large as the insert shoulder 25. This larger surface area enables the recess shoulder 15 to withstand substantially the same load as the insert shoulder 25, even though the yield strength of the insert shoulder 25 is greater than the yield strength of the recess shoulder 15. Cement will be then pumped down a drill string through the casing hanger 33 to return up the annular space around the casing. Returns from the cement will flow up the passages 53.

Figure 4:
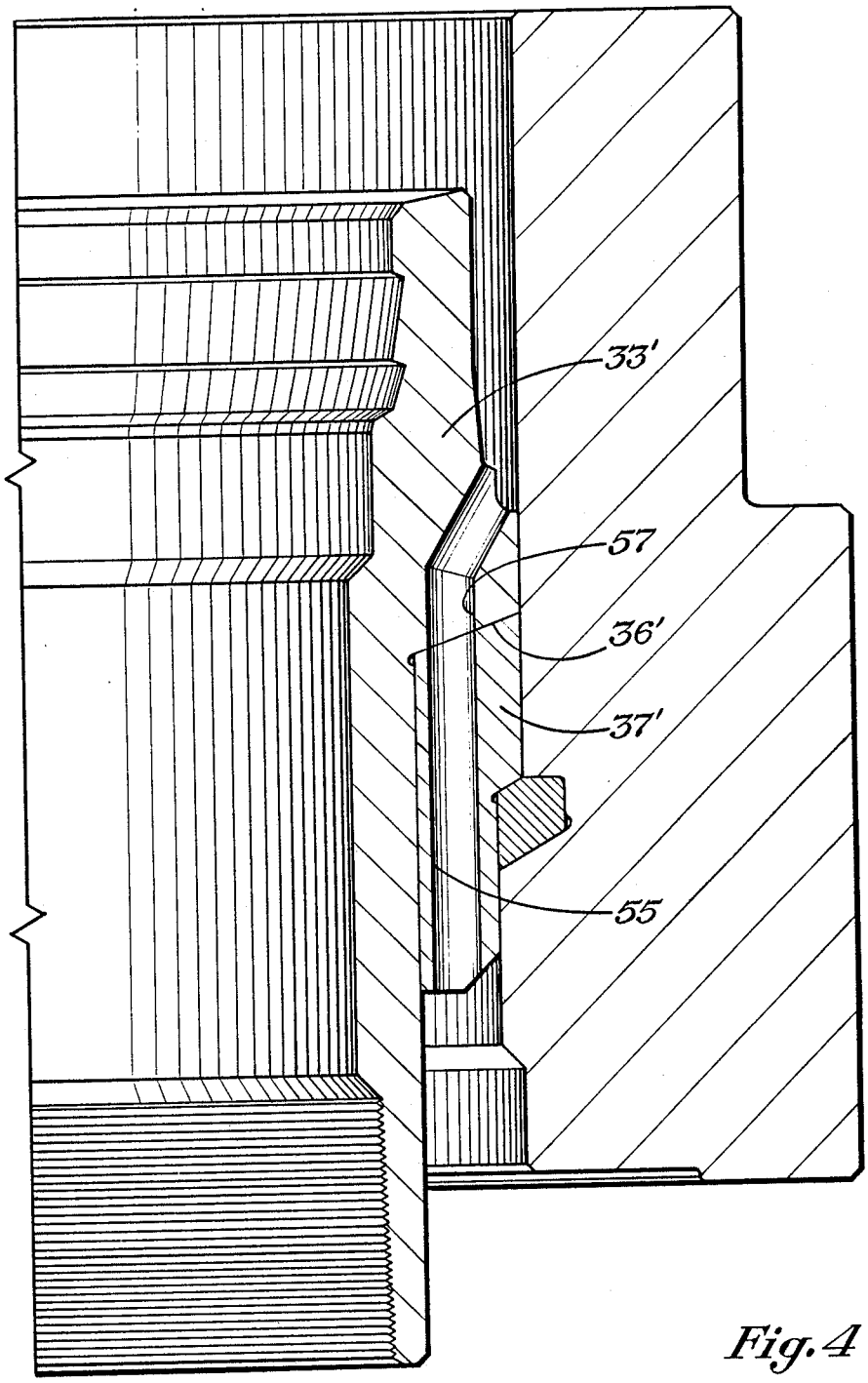
FIG. 4 is an alternate embodiment of a load supporting mechanism for a casing hanger in a wellhead.
Figure 1:
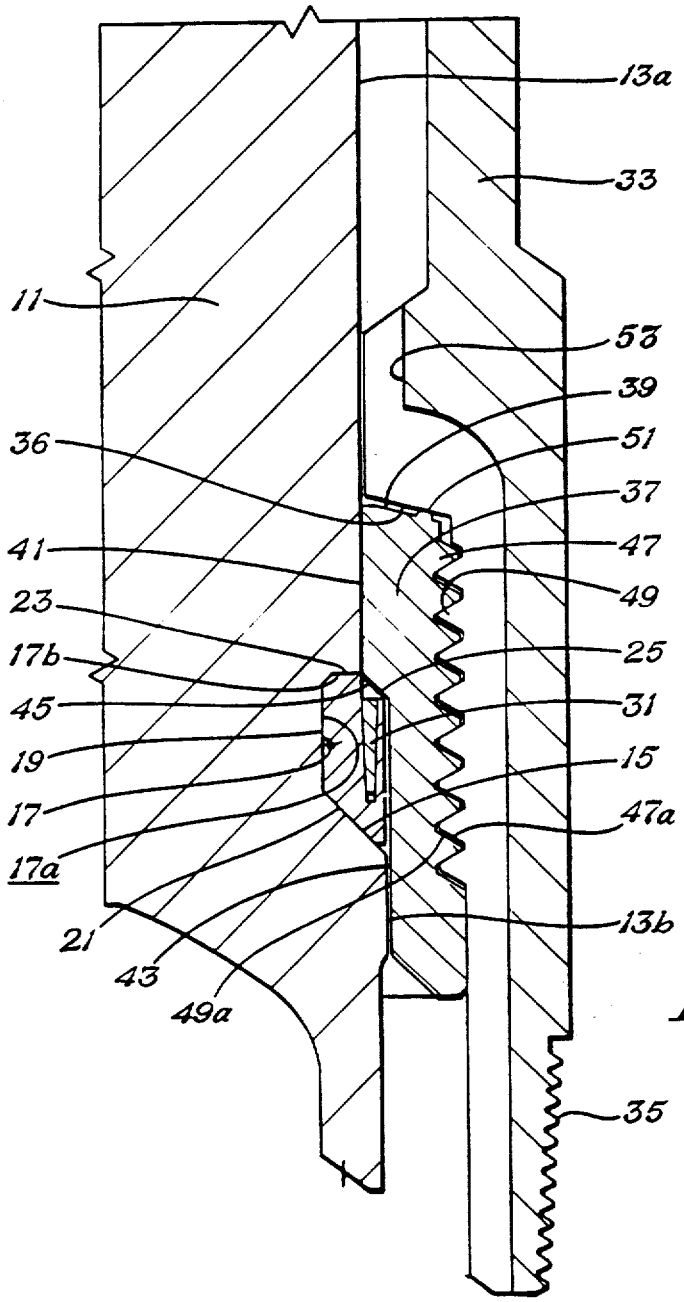

In the embodiment of FIG. 4, features which are the same as the first embodiment will not be discussed. In this embodiment, the difference is that the load ring 37' is not secured by any threads such as shown in FIG. 1. Rather, the load ring 37' is press fitted onto the exterior of the casing hanger 33'. Rather than slots 53 formed on the exterior of the casing hanger 33 as in FIG. 1, holes 55 are drilled through the load ring 37'. Mating holes 57 are drilled through the casing hanger 33'. The holes 57 extend from the shoulder 36' to the exterior above the casing hanger 33'. The passages 55, 57 serve as cement return passages.

The invention has significant advantages. The insert ring strengthens the single load shoulder in the wellhead housing, enabling it to withstand greater pressures or load. The insert ring has no moving parts, reducing any chance for malfunctioning to occur. The clearances and the protuberance on the load ring assure that the threads will load first, and not just the upper shoulder of the load ring.

The passages of the second embodiment provide better cross-sectional areas to avoid clogging of particles of the returns from cementing. Bearing capacity of the load ring of the alternate embodiment is maximized because of the continuity and surface contact between the casing hanger and wellhead housing. The structural integrity of the load ring is maximized in the alternate embodiment due to the distributed bridging of material between the flow passage holes.

While the invention has been shown in only two of its forms, it should be apparent to those skilled in the art that it is not so limited, but is susceptible to various changes without departing from the scope of the invention.

We claim:

1. In a well assembly having a wellhead housing with a bore for receiving a casing hanger, an improved means for supporting the casing hanger, comprising in combination:

an annular recess formed in the bore of the wellhead housing, having a base which is an upward facing frusto-conical shoulder having an inner diameter and a transverse dimension measured from its inner diameter to its outer extent;

the bore having an upper portion extending upward from the recess which has a greater diameter than the inner diameter of the recess shoulder;

a downward facing conical load shoulder on the casing hanger having a transverse dimension that is substantially less than the transverse dimension of the upward facing shoulder, the casing hanger having an upper portion extending above the load shoulder and a lower portion extending below the load shoulder, the casing hanger upper portion having an outer diameter greater than the inner diameter of the upward facing shoulder, the casing hanger lower portion having an outer diameter that is less than the inner diameter of the upward facing shoulder; and an annular insert member mounted in the recess, the insert member having a lower frusto-conical surface that mates with the upward facing shoulder and has substantially the same transverse dimension, the insert member having an inner diameter that is substantially the same as the inner diameter of the upward facing shoulder, so as to allow the lower portion of the casing hanger to be lowered through the insert member, the insert member having a frusto-conical upper shoulder which is contacted by the casing hanger load shoulder for supporting the casing hanger, the insert member being of a harder material than the material of the wellhead at the recess.

2. In a well assembly having a wellhead housing with a bore for receiving a casing hanger, an improved means for supporting the casing hanger, comprising in combination:

an annular recess formed in the bore of the wellhead housing, having an upward facing shoulder;

an annular insert member stationarily and rigidly mounted in the recess, the insert member having a lower surface mating with the upward facing shoulder, the insert member having an upper shoulder for supporting the casing hanger;

the insert member having three transverse cuts defining three separate segments each with two ends so as to allow the insert member to be installed in the recess without flexing, at least two of the cuts being parallel with each other;

a slot extending downward from the upper shoulder on each end of each segment, defining a downward extending cavity at each cut; and a dowel pin inserted into each cavity to hold the segments within the recess.

3. In a well assembly having a wellhead housing with a bore for receiving a casing hanger, an improved means for supporting the casing hanger, comprising in combination:

an annular recess formed in the bore of the wellhead housing, having an upward facing shoulder with a transverse width;

a downward facing shoulder formed on the exterior of the casing hanger, having a plurality of passages extending from below the downward facing shoulder to the exterior of the casing hanger above the downward facing shoulder;

a load ring having a lower end and an upper end and mounted to the casing hanger with the upper end in contact with the downward facing shoulder, the load ring having an upper cylindrical portion and a lower cylindrical portion of lesser diameter, defining a downward facing load shoulder, the load ring having a plurality of passages therethrough extending from the lower end to the upper end and communicating with the passages in the casing hanger for allowing cement returns; and an insert member stationarily and rigidly mounted in the recess, the insert member having a lower surface engaging the recess shoulder, the insert member having a shoulder surface contacted by the downward facing load shoulder for supporting the casing hanger, the shoulder surface having a transverse width that is substantially less than the transverse width of the upward facing shoulder, the insert member being of a harder material than the material of the wellhead at the recess to provide greater supporting strength for the casing hanger.

4. In a well assembly having a wellhead housing with a bore and an upward facing load shoulder for receiving a casing hanger, an improved means for supporting the casing hanger, comprising in combination:

a downward facing shoulder formed on the exterior of the casing hanger;

a plurality of exterior grooves formed on the exterior of the downward facing below the casing hanger shoulder, each exterior groove having a downward facing load flank;

a load ring having a plurality of interior grooves that mate with the exterior grooves on the casing hanger, each interior groove having an upward facing load flank that mates with one of the downward facing load flanks, the load ring having an upper end located below the downward facing shoulder, the load ring having an upper cylindrical portion and a lower cylindrical portion of lesser diameter, defining a downward facing load shoulder for engaging the upward facing load shoulder in the bore to transmit load on the casing hanger through the load ring to the wellhead housing;

the grooves of the load ring being dimensioned such that a groove clearance exists between each of the flanks and a shoulder clearance exists between the upper end of the load ring and the downward facing shoulder prior to transmitting a downward load through the load ring to the wellhead housing; and means located between the upper end of the load ring and the downward facing shoulder for maintaining the shoulder clearance when load is applied until the groove clearances close up, then for allowing the shoulder clearance to close up.

5. In a well assembly having a wellhead housing with a bore and an upward facing load shoulder for receiving a casing hanger, an improved means for supporting the casing hanger, comprising in combination:

a downward facing shoulder formed on the exterior of the casing hanger;

a plurality of exterior grooves formed on the exterior of the downward facing below the casing hanger shoulder, each exterior groove having a downward facing load flank;

a load ring having a plurality of interior grooves that mate with the exterior grooves on the casing hanger, each interior groove having an upward facing load flank that mates with one of the downward facing load flanks, the load ring having an upper end located below the downward facing shoulder, the load ring having an upper cylindrical portion and a lower cylindrical portion of lesser diameter, defining a downward facing load shoulder for engaging the upward facing load shoulder in the bore to transmit load on the casing hanger through the load ring to the wellhead housing;

the grooves of the load ring being dimensioned such that a groove clearance exists between each of the flanks and a shoulder clearance exists between the upper end of the load ring and the downward facing shoulder prior to transmitting a downward load through the load ring to the wellhead housing; and a deformable member located between the upper end of the load ring and the downward facing shoulder for maintaining the shoulder clearance when load is applied until the groove clearances close up, then for deforming under continued load for allowing the shoulder clearance to close up.

* * * * *

UNITED STATES PATENT AND TRADEMARK OFFICE

CERTIFICATE OF CORRECTION

PATENT NO. : 4,919,460

DATED : 04/24/90

INVENTOR(S) : Lionel J. Milberger, et al.

It is certified that error appears in the above-identified patent and that said Letters Patent is hereby corrected as shown below:

The title page, showing the illustrative figure, and Drawing Sheet 1 should be deleted to be replaced with the attached title page and Drawing Sheet 1, showing that "139" should be --13a-- and that the lines extending to the left at the bottom of the member 33 and at the bottom of member 11, should be deleted from Figure 1;

At column 6, line 69, "downward facing" should be --casing hanger--;

At column 6, line 69, "casing hanger" should be --downward facing--.

Signed and Sealed this

Seventh Day of April, 1992

*Attest:*

HARRY F. MANBECK, JR.

*Attesting Officer*

*Commissioner of Patents and Trademarks*

United States Patent [19]

Milberger et al.

[11] Patent Number: 4,919,460

[45] Date of Patent: Apr. 24, 1990

[54] WELLHEAD CASING HANGER SUPPORT MECHANISM

[75] Inventors: Lionel J. Milberger; Herman O. Henderson, Jr., both of Houston, Tex.

[73] Assignee: Vetco Gray Inc., Houston, Tex.

[21] Appl. No.: 307,412

[22] Filed: Feb. 6, 1989

[51] Int. Cl.[5] ..... E21B 33/04

[52] U.S. Cl. ..... 285/141; 205/143; 166/75.1; 166/208

[58] Field of Search ..... 166/382, 75.1, 85, 208; 285/140–143

[56] References Cited

U.S. PATENT DOCUMENTS

| | | | |
|---|---|---|---|
| 2,010,284 | 8/1935 | Wickersham | 285/141 |
| 2,178,549 | 11/1939 | Block . | |
| 3,284,111 | 11/1966 | Pinkard . | |
| 4,167,970 | 9/1979 | Cowan | 166/208 |
| 4,460,042 | 7/1984 | Galle, Jr. . | |
| 4,528,738 | 7/1985 | Galle, Jr. | 285/141 |
| 4,550,782 | 11/1985 | Lawson . | |
| 4,577,686 | 3/1986 | Milberger et al. | 166/208 |
| 4,595,053 | 6/1986 | Watkins et al. | 166/382 |
| 4,641,708 | 2/1987 | Wightman | 166/217 |
| 4,826,216 | 5/1989 | Hynes et al. | 166/208 |

FOREIGN PATENT DOCUMENTS 0261909 3/1988 European Pat. Off. .

*Primary Examiner*—Bruce M. Kisliuk
*Attorney, Agent, or Firm*—James E. Bradley

[57] ABSTRACT

A supporting mechanism for a casing hanger improves the load withstanding ability. The casing hanger is located in a wellhead housing. A recess is formed in the bore of the wellhead housing with an upward facing shoulder extending into the bore. An insert ring is stationarily and rigidly mounted in this recess. The insert ring has a load shoulder on its upper side. The load shoulder of the insert ring is considerably less in width than the recess shoulder. However, the insert ring has a greater hardness to increase the capacity of the insert ring. The casing hanger has an exterior load ring that lands on the insert ring. The load ring has threads which are cut to have clearances initially between the load flanks. A clearance also exists between the upper end of the load ring and a downward facing shoulder on the casing hanger. A protuberance on the upper end of the load ring maintains this upper clearance until the load flank clearances close up, then allows the upper clearance to close up to assure loading through the flanks.

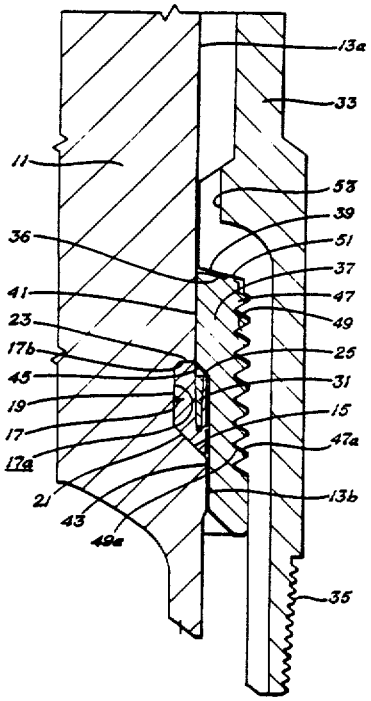

5 Claims, 3 Drawing Sheets